United States Patent [19]

Legrand

[11] 4,306,513

[45] Dec. 22, 1981

[54] WEATHER-VANE STEERING-DEVICE AND COUPLING DEVICE FOR USE IN SUCH WEATHER-VANE STEERING DEVICE

[76] Inventor: Marie G. J. Legrand, Zolder, Belgium

[21] Appl. No.: 73,027

[22] Filed: Sep. 6, 1979

[30] Foreign Application Priority Data

Sep. 8, 1978 [BE] Belgium ..... 2/57259

[51] Int. Cl.[3] ..... B63H 25/04

[52] U.S. Cl. ..... 114/144 C; 74/417; 74/665 C; 74/713

[58] Field of Search ..... 114/144 C, 144 E, 144 R; 74/417, 665 C, 713

[56] References Cited

U.S. PATENT DOCUMENTS 3,942,461 3/1976 Smith ..... 114/144 C

FOREIGN PATENT DOCUMENTS 2407508 6/1979 France ..... 114/144 C 1276567 6/1972 United Kingdom ..... 114/144 C

*Primary Examiner*—Sherman D. Basinger

*Attorney, Agent, or Firm*—Stevens, Davis, Miller & Mosher

[57] ABSTRACT

A weather-vane steering-device comprises a gearbox secured to a boat, a turntable rotatable in the gearbox, a weather-vane rotatable in the turntable, a steering element rotatable in the gearbox, a first differential gear between the weather-vane and the steering element, and a second differential gear between the turntable and the gearbox, a freely rotating member of the first differential gear being connected to a freely rotating member of the second differential gear.

10 Claims, 7 Drawing Figures

WEATHER-VANE STEERING-DEVICE AND COUPLING DEVICE FOR USE IN SUCH WEATHER-VANE STEERING DEVICE

BACKGROUND

The invention relates to a coupling device between a first mechanism having a stator and a rotor and a second mechanism having a stator and a rotor, in which all stators and rotors have the same geometrical axis, and the stator of the second mechanism can be turned around the geometrical axis relative to the stator of the first mechanism.

In this specification and in the accompanying claims, the terms stator and rotor must not be understood in an absolute sense. By rotor is understood an element that can be turned relative to the stator about the common geometrical axis, without necessarily being permitted to turn through the full 360°. Also, the term stator does not mean that this element is inmovably connected to its surroundings.

THE INVENTION

The principal object of the present invention is to provide a coupling device between two combinations each comprising a rotor and a stator with such connections between the component parts of these combinations that a rotation of the second rotor in the second stator results in a proportional rotation of the first rotor in the first stator, and this independent of the rotation of the two stators relative to each other.

For this purpose the two rotors are interconnected by a first differential gear, the two stators are interconnected by a second differential gear, and a freely rotating member of the first differential gear is connected to a freely rotating member of the second differential gear.

In this specification and in the accompanying claims the term differential gear means any unit comprising a first gear wheel, a second gear wheel and at least one planet wheel which is in engagement with said first and said second gear wheel, irrespective of whether the first and the second gear wheel are bevel wheels located in parallel planes and the planet wheel is a bevel wheel located in a plane perpendicular to those of the other wheels, or the first gear wheel, the second gear wheel and the planet wheel are straight gear wheels located in one and the same plane.

Preferably, the two differential gears have the same transmission coefficients.

In a particular embodiment of the invention, the first differential gear comprises a first gear wheel fixedly mounted on the rotor of the first mechanism, a second gear wheel fixedly mounted on the rotor of the second mechanism, and at least one planet wheel loosely mounted around a free spindle and in engagement with the first gear wheel and with the second gear wheel. The second differential gear comprises a first gear wheel fixedly mounted on the stator of the first mechanism, a second gear wheel fixedly mounted on the stator of the second mechanism, and at least one planet wheel loosely mounted around a free spindle and in engagement with the first gear wheel and with the second gear wheel, and the spindles mounting the planet wheels of the first and the second differential gear are interconnected.

In another special embodiment of the invention, the first differential gear comprises a first, freely rotating gear wheel, a second gear wheel fixedly mounted on the rotor of the second mechanism, and at least one planet wheel loosely mounted around a spindle that is fixed relative to the rotor of the first mechanism and in engagement with the first and with the second gear wheel, the second differential gear comprises a first freely rotating gear wheel, a second gear wheel fixedly mounted on the stator of the second mechanism, and at least one planet wheel loosely mounted around a spindle that is fixed relative to the stator of the first mechanism and in engagement with the first and the second gear wheel, and the first gear wheels of the first and of the second differential gear are interconnected.

FURTHER BACKGROUND

Although the coupling device described above can have various uses, its use in a weather-vane steering-device is particularly indicated.

In this spirit, the invention concerns in particular a weather-vane steering-device comprising:

- a gearbox to be fixedly secured to a boat,
- a turntable rotatable in the gearbox about a substantially vertical axis,
- a weather vane mounted for rotation relative to said turntable,
- a steering element mounted for rotation relative to the gearbox,
- a connection between the turntable and the gearbox with the possibility of adjustment, and

- a connection between the weather vane and the steering element.

Such weather-vane steering-devices are described, inter alia, in the publication "Windvaanstuurinrichtingen" (Weather-vane Steering-devices) by Gerard Dijkstra (1975, Uniboek B. V., Bussum, the Netherlands).

A weather-vane steering-device keeps a vessel at a constant angle to the apparent wind during sailing, under the control of a weather vane. In this arrangement the weather vane acts on a steering element, for example on the rudder, an auxiliary rudder, a trimming surface or a pendulum. When the boat deviates from its correct course, i.e. the course under the above constant angle with the apparent wind, the weather vane turns relative to the turntable. From this rotation of the weather vane, a rotation of the steering element is derived through the connection between the weather vane and the steering element. The steering element thereby turns relative to the gearbox. The resulting deviation of the steering element relative to the central position it occupies when the ship maintains the correct constant angle with the apparent wind corrects the course and brings the ship back to the desired constant angle with the apparent wind.

The adjustment of the direction of sailing relative to the apparent wind is effected by turning the turntable, which after this adjustment, for the further operation, can be regarded as fixed relative to the gearbox.

If the above-mentioned rotation of the weather vane is converted exclusively by rotating elements into the above-mentioned rotation of the steering element, it has hitherto been necessary, during the adjustment, to uncouple the connection between the weather vane and the steering element.

According to the state of the prior art, this uncoupling during the adjustment by a rotation of the turntable relative to the gearbox can only be avoided if the connection between the weather vane and the steering element comprises a rod or cables which extend in accordance with the geometrical axis around which the turntable is rotated, and which undergo translation in the direction of this axis; the rotation of the weather vane is then converted into a translation of the rod or cables and this translation is converted into a rotation of the steering element.

THE INVENTION

It is an object of the present invention to provide a weather-vane steering-device in which the connection between the weather vane, on the one hand, and the steering element, on the other, comprises exclusively rotating elements, in which therefore any translation is ruled out, while yet during the rotation of the turntable the dragging effect of the turntable on the connection last mentioned is accurately compensated.

For this purpose the connection between the weather vane and the steering element consists in a first differential gear, the connection between the turntable and the gearbox consists in a second differential gear, and a freely rotating member of the first differential gear is connected to a freely rotating member of the second differential gear.

In an advantageous embodiment of the invention, the first differential gear comprises a first gear wheel directly coupled to the steering element, a second gear wheel directly coupled to the weather vane, and at least one planet wheel loosely mounted on a free spindle and in engagement with the first and with the second gear wheel. The second differential gear comprises a first gear wheel fixedly connected to the gearbox, a second gear wheel fixedly connected to the turntable, and at least one planet wheel loosely mounted around a free spindle and in engagement with the first and the second gear wheel, and the free spindles mounting the planet wheels of the first and second differential gear are interconnected.

In a simple embodiment of the invention, the free spindles mounting the planet wheels of the first and of the second differential gear are one element.

In another advantageous embodiment of the invention, the first differential gear comprises a first freely rotating gear wheel, a second gear wheel directly coupled to the weather vane, and at least one planet wheel loosely mounted around a spindle directly coupled to the steering element and in engagement with the first and with the second gear wheel, the second differential gear comprises a first freely rotating gear wheel, a second gear wheel fixed relative to the turntable, and at least one planet wheel loosely mounted around a spindle fixedly connected to the gearbox and in engagement with the first and with the second gear wheel, and the first gear wheels of the first and of the second differential gear are interconnected.

In an effective embodiment of the invention, the gear wheels of at least one differential gear are bevel gears.

In another effective embodiment of the invention, the gear wheels of at least one differential gear are straight co-planar gear wheels, in which one gear wheel is an internally geared crown wheel.

Another object of the invention is the provision of a weather-vane steering-device in which the slope of the spindle of the weather vane relative to the horizontal plane can be adjusted in a simple manner within a broad range, preferably at least between 0° and 90°.

For this purpose the spindle of the weather vane is journalled in a top portion of the turntable, which top portion pivots about a substantially horizontal shaft relative to a lower portion of the turntable, which lower portion is rotatable in the gearbox, there being provided a means for fixedly securing said top portion relative to said lower portion.

In an advantageous embodiment of the invention, the top portion pivots relative to the lower portion between a substantially vertical and a substantially horizontal position.

Preferably the spindle of the weather vane journalled in the top portion is connected through a shaft to a vertical shaft journalled in the lower portion, by means of two universal joints.

Other features and advantages of the invention will become apparent from the following description of various embodiments of a weather-vane steering-device according to the invention with reference to the accompanying drawings. This description is given by way of example only, and is not intended to limit the invention in any way. In said drawings

THE DRAWINGS

FIG. 1 is a diagrammatic part-sectional side elevation of a weather-vane steering-device according to the invention, FIG. 2 is a diagrammatic part-sectional side elevation, showing a second weather-vane steering-device according to the invention, FIG. 3 is a diagrammatic plan view of the weather vane from the device shown in FIG. 2, FIG. 4 is a diagrammatic plan view of a portion of the control arrangement of the steering element from the device shown in FIG. 2, FIG. 5 is a diagrammatic part-sectional side elevation, showing a third weather-vane steering-device according to the invention, FIG. 6 is a diagrammatic part-sectional side elevation of a portion of a fourth weather-vane steering-device according to the invention, and FIG. 7 is a diagrammatic part-sectional side elevational view of a fifth weather-vane steering-device according to the invention.

In the various figures, like reference numerals relate to like elements or elements performing an analogous function.

DESCRIPTION OF THE PREFERRED EMBODIMENTS

Figure 1:
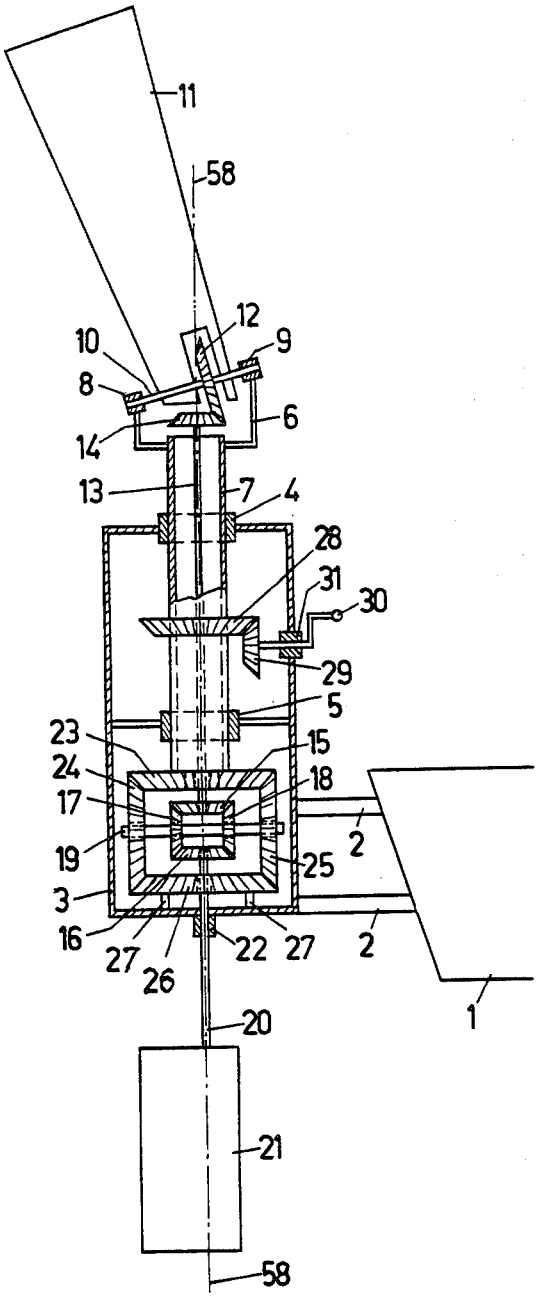

The weather-vane steering-device shown in FIG. 1 comprises a gearbox 3 which is connected by means of supports 2 to the stern portion of a boat 1. Mounted in gearbox 3 by means of bearings 4 and 5 is a hollow shaft 7 of a turntable 6. Shaft 7 can rotate in bearings 4 and 5 but is unable to slide up and down in them. After the device has been mounted, shaft 7 is substantial vertical. "Vertical" is to be regarded, within the framework of this patent application, with regard to the position occupied when the boat is at rest on the water.

At the top, turntable 6 carries two bearings 8 and 9 journalling a spindle 10 for rotation but restrained from sliding movement. Fixedly mounted on splindle 10 are a weather vane 11 and a bevel gear 12.

In a manner not shown in the drawing, a rod 13 is mounted within the hollow shaft 7 of the turntable. Rod 13 can rotate within shaft 7, but is unable to move up and down in it. At the top, rod 13 carries a bevel gear 14, which is in engagement with bevel gear 12 of vane spindle 10. At the bottom, rod 13 carries a bevel gear 15.

Gear 15 forms the second gear wheel of a first differential gear, the first gear wheel of which is designated by reference numeral 16, and the planet wheels of which are designated by reference numerals 17 and 18. These planet wheels are mounted loosely around a free shaft 19 which is not fixedly connected either to gearbox 3 or to any other element. Planet wheels 17 and 18 can rotate loosely around shaft 19, but are unable to move in the axial direction of shaft 19.

The first gear wheel 16 of the differential gear consisting of gear wheels 15 and 16 and planet wheels 17 and 18 is fixedly mounted on a rudder shaft 20, which carries a rudder 21. Rudder shaft 20 is mounted for rotation, but restrained from sliding movement in a bushing 22 belonging to gearbox 3.

At its lower end, shaft 7 of the turntable carries a second gear wheel 23 of a second differential gear, which further comprises planet wheels 24 and 25 and the first gear wheel 26. Planet wheels 24 and 25 are mounted on the free shaft 19. They are able to rotate about this shaft, but unable to move to and fro on it. The same free shaft 19 accordingly carries planet wheels 17 and 18 of the first differential gear and planet wheels 24 and 25 of the second differential gear, and so forms the coupling between the freely rotating elements 17, 18 and 24, 25 of the two differential gears. The first gear wheel 26 of the second differential gear is fixedly connected to gearbox 3 by means of connecting members 27.

Fixedly mounted on the outside of shaft 7 of the turntable, is a bevel gear 28. Gear 28 is in engagement with a bevel gear 29, which itself is fixedly mounted on the end of a crank 30, which can rotate in bearing 31 mounted in the wall of gearbox 3.

During normal navigation under the control by the weather vane, i.e. after the course has been set, the turntable can be regarded as being fixed relative to gearbox 3. As the first gear wheel 26 of the second differential gear is also fixedly connected to gearbox 3, and the second gear wheel 23 of this differential gear is fixedly mounted on the shaft 7 of the turntable, planet wheels 24 and 25 of this first differential gear also remain fixed, and the free shaft 19 occupies a fixed position relative to gearbox 3. If, under these conditions, as a consequence of a departure from the course of the boat relative to the adjusted angle to the apparent wind, vane 11 turns, the movement of vane 11 is transmitted by spindle 10, bevel gears 12 and 14 and hence by rod 13 to bevel gear 15. The movement of gear 15 is transmitted through planet wheels 17 and 18, which are loosely mounted on shaft 19, to bevel gear 16 and hence to rudder shaft 20 and to rudder 21. Rudder shaft 21 is accordingly pivoted and corrects the course in the opposite sense from the deviation to which the pivoting movement of vane 11 is due. During this operation shafts 13 and 20 have different senses of rotation.

For the above-described operation of the weather-vane steering-device, it is supposed that turntable 6 and hence its shaft 7 are fixed relative to gearbox 3. At a zero position of turntable 6, rudder 21 is positioned in the vertical longitudinal plane of boat 1, if vane 11 is located in the same vertical plane. Accordingly, spindle 10 is in the same plane; naturally spindle 10 remains in this same vertical plane so long as turntable 6 with its shaft 7 are not rotated in gearbox 3. The above course corrections in the zero position of turntable 6 are realized by rocking movements of rudder 21 with its shaft 20 about the geometrical axis of shaft 20, which are the result of rocking movement of vane 11 with its spindle about the geometrical axis of spindle 10. In the zero position of the turntable the course set is such that the longitudinal direction of the boat coincides with the apparent wind.

When the direction of navigation is adjusted to a different angle to the apparent wind, turntable 6 is rotated. This rotation is effected by means of crank 30, the rotary movements of which are transmitted through the intermediary of bevel gears 29 and 28 to shaft 7 of the turntable 6. Along with shaft 7, the second gear wheel 23 of the second differential gear rotates in gearbox 3. In fact this second gear wheel 23 is fixedly mounted on shaft 7. As the first gear wheel 26 of this differential gear is fixed relative to gearbox 3, planet wheels 24 and 25 are necessarily displaced over the fixed second gear wheel 26, so that the free shaft 19, loosely mounting planet wheels 24 and 25, revolves about the axis of the hollow shaft 7. During this movement of the free shaft 19, planet wheels 17 and 18 of the first differential gear are naturally carried along. If, during this movement, vane 11 remains in the apparent wind direction, and hence the second gear wheel 15 of the first differential gear must be regarded as fixed relative to the apparent wind direction, rotation of the free shaft 19, which is accompanied by the rotation of turntable 6, will cause a rotation of planet wheels 17 and 18 and hence of the first gear wheel 16, of rudder shaft 20 and of rudder 21. The rudder has thus been given a new central position relative to the direction of spindle 10. From this new central position, the corrections are brought about for deviations from the new correct course, which are determined by vane 11.

In order that the angle between the new central position of rudder 21 and spindle 10 of the weather vane may be equal to the angle through which shaft 7 of turntable 6 is rotated in gearbox 3, the two differential gears must have the same coefficients of transmission.

By coefficients of transmission are to be understood here the ratio between, on the one hand, the angle through which the second gear wheel 15, or 23, is to be rotated with a stationary gear wheel 16, or 26, and on the other hand, the angle through which shaft 19 is rotated in the plane perpendicular to shafts 13 and 20.

The above-described weather-vane steering-device according to FIG. 1 is a special case of a coupling device between a first mechanism whose stator is formed by gearbox 3 and whose rotor is formed by rudder shaft 20, and a second mechanism whose stator is formed by shaft 7 of the turntable and whose rotor is formed by rod 13. Gearbox 3, shaft 7 of the turntable, rudder shaft 20 and rod 13 have the same geometrical axis 58, and the stator of the second mechanism, i.e. the shaft 7 of turntable, can be turned relative to the stator of the first mechanism, i.e. relative to gearbox 3, about this geometrical axis. As can be derived from the above description, the two rotors, i.e. rudder shaft 20 and rod 13, are interconnected by a first differential gear, and the two stators, i.e. gear box 3 and the shaft 7 of turntable, are interconnected by a second differential gear. The first differential gear consists of first gear wheel 16, second gear wheel 15 and the two planet wheels 17 and 18. The second differential gear consists of the first gear wheel 26, second gear wheel 23 and planet wheels 24 and 25. The freely rotating members of these differential gears are, on the one hand, planet wheels 17 and 18 and, on the other, planet wheels 24 and 25. These freely-rotating members are interconnected as they are mounted on one and the same shaft 19, which shaft, however, can freely move in a plane perpendicular to rod 13 and to rudder shaft 20.

Figure 2:
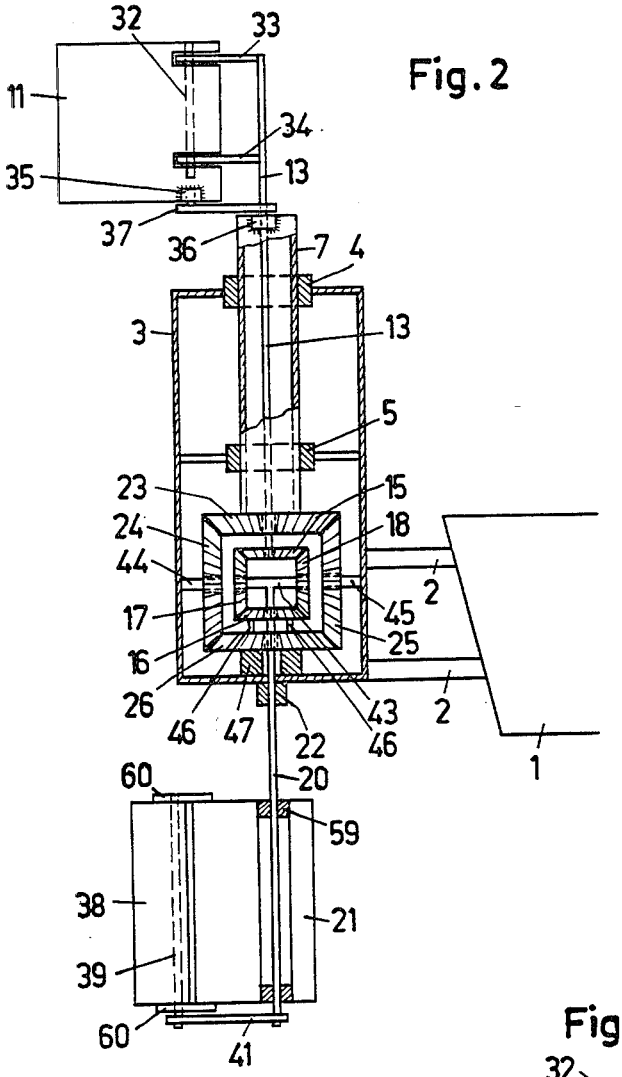
Figure 3:
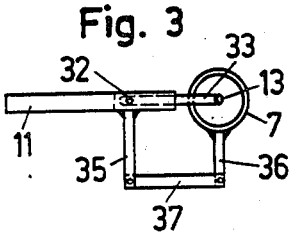

The embodiment shown in FIG. 2 is mainly different from that shown in FIG. 1 in the nature of the weather vane, the nature of the steering element on which the weather vane acts, and in the connection between the first and the second differential gears.

Where, in the embodiment of FIG. 1, the weather vane was directly mounted on a sloping spindle 10 journalled in turntable 6, in the embodiment of FIG. 2, the weather vane is of the type having a double vertical spindle.

Weather vane 11 pivots about vertical pins 32. These vertical pins, which are in alignment with each other and so define one geometrical axis, form a framework together with rod 13 and arms 33 and 34. This framework forms one whole with rod 13 and hence rotates along with this rod. A parallelogram construction is formed by the arm 35, which is fixed to vane 11, the arm 36, which is fixed relative to shaft 7 of the turntable, and the connecting rod 37, which pivots relative to arms 35 and 36. Such a weather vane with a double vertical spindle is well-known, and upon deviation of the boat from its correct course effects a rotation of rod 13 in the turntable. Owing to the guidance by the parallelogram construction, weather vane 11 remains parallel to itself relative to the turntable, in this case consisting in the shaft 7. The deviation from the central position of weather vane 11 results in a rotation of rod 13 in turntable 7.

Figure 4:
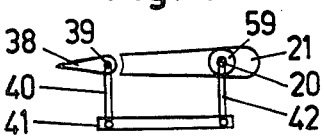

In the embodiment of FIG. 2, as can be derived from the diagrammatic plan view of FIG. 4, shaft 20, which in the embodiment of FIG. 1 is directly connected to rudder 21, is connected through a parallelogram construction to a trimming surface 38. Rudder 21 pivots freely about shaft 20, to which it is connected by means of bearings 59. At the top and bottom, supports 60 are secured to rudder 21. These supports 60 journal shaft 39. The trimming surface 38 is fixed to this shaft 39, which also carries arm 40. A connecting rod 41 is pivoted to arm 40, and to arm 42, which is fixed to shaft 20. The movement of shaft 20 is accordingly transmitted to trimming surface 38, which through its movement causes rudder 21 to move in the opposite sense.

Planet wheels 17 and 18 of the first differential gear are loosely mounted around a shaft 43, which is fixed to shaft 20. Planet wheels 24 and 25 of the second differential gear are respectively carried by shafts 44 and 45, which are fixedly connected to gearbox 3. The planet wheels of the two differential gears are, accordingly, no longer on one and the same shaft. They are able to rotate around their shafts without being able to move in the longitudinal direction of their shafts.

The first gear wheels 16 and 26 are now the freely rotating members of the two differential gears; they are interconnected by connecting members 46. They rotate together around shaft 20 in gearbox 3, in which they are supported by support 47. This support prevents the first gear wheels 16 and 26 of the differential gears from sliding up and down, but does not prevent them from rotation.

When the weather-vane steering-device must keep the boat in its correctly set course, i.e., after adjustment of the turntable, this turntable, in this case consisting in shaft 7, can be considered fixed relative to gearbox 3. If the boat deviates from its correct course, i.e. the course in which the axis of boat 1 makes a well-defined angle with the apparent wind, the weather vane imparts a rotary movement to rod 13. As, at that moment, the turntable is fixed, bevel gear 23 will also be fixed relative to the gearbox. This also applies to planet wheels 24 and 25, which are maintained by gear 23 in a fixed position on shafts 44 and 45, which themselves are fixed to the gearbox. This, accordingly, also applies to the first gear wheel 26 of the second differential gear, which is kept in a fixed position by planet wheels 24 and 25. This applies, finally, also to the first gear wheel 16 of the first differential gear, which is fixedly connected to the first gear wheel 26 of the second differential gear. The rotation of the second gear wheel 15 along with rod 13, to which this wheel is fixedly connected, accordingly results in planet wheels 17 and 18 rolling over gear wheel 16 which at that moment is to be regarded as fixed, so that shaft 43 rotates about the geometrical axis of rod 13. As a consequence, shaft 20, which is connected to shaft 43, is rotated, and this movement is transmitted by means of arms 40 and 42 and connecting rod 41 to the trimming surface 38.

In this way any deviation from the correct course that is determined by vane 11 is corrected through action on trimming surface 38. In this arrangement, shafts 13 and 20 have the same sense of rotation, but different angles of rotation.

When the direction of movement of the boat is set to a different angle to the apparent wind, turntable 7 is rotated. This rotation is effected by means not shown in FIG. 2. Such means are shown in FIG. 1. With turntable 7, the second gear wheel 23 of the second differential gear rotates in the gearbox 3. As the planet wheels 24 and 25 are loosely mounted on shafts 44 and 45, which shafts are fixed relative to the gearbox, the planet wheels 24 and 25 will necessarily rotate around their shafts 44 and 45. Thereby they effect a rotation of the first gear wheel 26 of the second differential gear, and hence a like rotation of the first gear wheel 16 of the first differential gear. If, during this movement, the vane 11 remains in the apparent wind direction, and hence the second gear wheel 15 of the first differential gear may be regarded as fixed relative to the apparent wind direction, the rotation of gear wheel 16 along with gear wheel 26 will cause planet wheels 17 and 18 to roll over gear 15, and hence cause shaft 43 on which they are mounted to rotate around the axis of rod 13. As a consequence, shaft 20 is rotated about the same axis. Trimming surface 38, which thereby is also rotated will thus aquire a new central position relative to the turntable. From this new central position the corrections are effected for deviations from the new correct course, which are determined by vane 11.

The embodiment illustrated in FIG. 2 accordingly also relates to a weather-vane steering-device that can be regarded as a particular case of a coupling device. In this coupling device, the first differential gear comprises a first freely rotating gear wheel 16, a second gear wheel 15 fixed on the rotor of the second mechanism, i.e. on rod 13 and planet wheels 17 and 18 loosely mounted on a shaft 43, which is fixed relative to the rotor of the first mechanism, i.e. relative to shaft 20, and in engagement with the first gear wheel 16 and with the second gear wheel 15. The second differential gear of the coupling mechanism comprises a first freely rotating gear wheel 26, a second gear wheel 23 fixed on the stator of the second mechanism, i.e. on turntable 7, and planet wheels 24 and 25 loosely mounted on shafts 44 and 45, which are fixed relative to the stator of the first mechanism, i.e. relative to gearbox 3, and in engagement with the first gear wheel 26 and with the second gear wheel 23. The connection between the free members of the differential gears is formed by the connecting members 46 between the first gear wheel 16 of the first differential gear and the first gear wheel 26 of the second differential gear.

Figure 5:
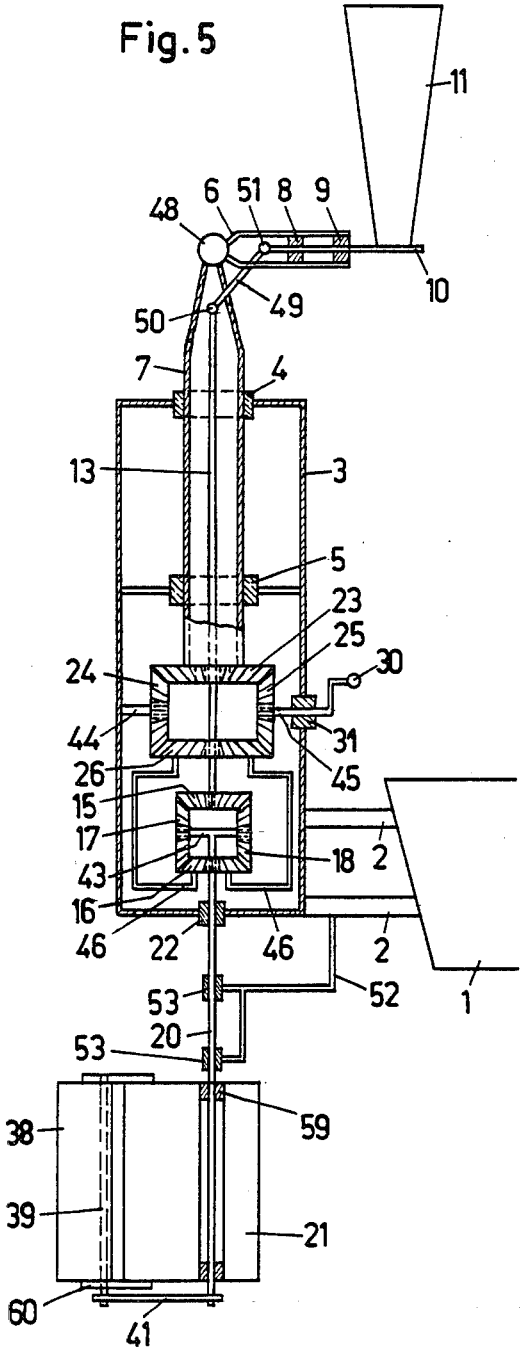

The embodiments shown in FIG. 5 is mainly different from that illustrated in FIG. 2 in the nature of the weather vane and in the relative position of the first differential gear relative to the second differential gear.

In the embodiment shown in FIG. 5, the top portion 6 of the turntable pivots about a horizontal shaft 48 relative to the lower portion of the turntable, consisting in the vertical shaft 7. The top portion of the turntable can be fixed in position relative to the lower portion. The two portions 6 and 7 are fixed relative to each other both for the adjustment of the turntable relative to the gearbox and during normal operation of the weather-vane steering-device. Mounted in the top portion 6 of the turntable are bearings 8 and 9, journalling spindle 10. This spindle 10 carries the weather vane 11. According to the position of the pivoting top portion 6 of the turntable relative to the lower portion 7, this spindle 10 is in a horizontal, vertical or sloping position.

Spindle 10 is connected by means of a shaft 49 to rod 13 with two universal joints 50 and 51, so that any rotation of weather vane 11 is transmitted to rod 13. Where, in the embodiment of FIG. 2, the first differential gear with gear wheels 15 and 16 and planet wheels 17 and 18 is accommodated in the space that remains unoccupied in the second differential gear comprising gear wheels 23 and 26 and planet wheels 24 and 25, in the embodiment of FIG. 5 this first differential gear is mounted fully under the second differential gear, but this does not affect the operation described hereinbefore with reference to FIG. 2. FIG. 5 also shows supports 52 and bearings 53 of rudder shaft 20, but these elements can be left out of consideration with respect to the operation of the weather-vane steering-device.

FIG. 5 also shows the manner in which turntable 7 can be rotated in the gearbox. The planet bevel gear 25 of the second differential gear is fixedly mounted on shaft 45, and this shaft can rotate in bearing 31 mounted in the wall of gearbox 3. Mounted at the end of shaft 45 outside the gearbox is a crank 30. to rotate turntable 7 in gearbox 3, it is accordingly sufficient for shaft 45 to be turned with crank 30, whereby bevel gear 25 is rotated. This rotary movement is transmitted by bevel gear 23 to the turntable.

Figure 6:
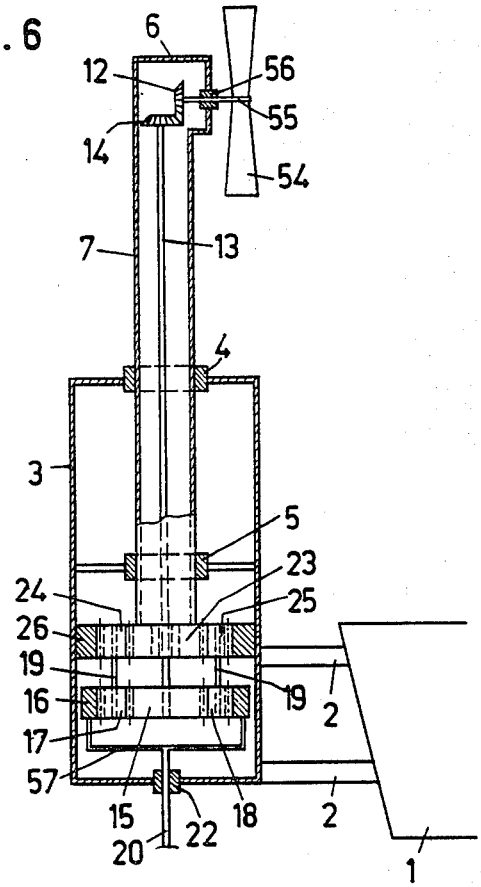

The embodiment of FIG. 6 comprises a propeller vane 54. The spindle 55 of this vane is journalled in bearing 56, fixedly mounted in turntable 6. Fixedly mounted on spindle 55 is a bevel gear 12, which is in engagement with bevel gear 14 fixed on the upper end of rod 13. Any deviation relative to the correct direction of travel will result in spindle 55 being rotated, which rotation is transmitted by gear wheels 12 and 14 to rod 13. For the rest the embodiment of FIG. 6 is similar to that of FIG. 1. The differential gears, however, are not formed with bevel gears, but with straight gear wheels, which are co-planar for each of the differential gears. In the first differential gear, the outer gear wheel 16, which takes the form of an internally geared crown wheel, is connected by means of connections 57 to the rudder shaft 20. The second gear wheel 15 of this first differential gear is fixedly mounted on rod 13, the position of which is determined by propeller vane 54. Planet wheels 17 and 18 of this first differential gear are loosely mounted on the same free shafts 19 as are the planet wheels 24 and 25 of the second differential gear. Planet wheels 17 and 24 and 18 and 25 are loosely mounted on the free shafts 19 without being able to slide on these shafts. Of the second differential gear, the second gear wheel 23 is fixedly mounted on shaft 7 of the turntable and the first gear wheel 26 takes the form of an internally geared crown wheel. This gear wheel is fixed to the wall of gearbox 3.

Shafts 13 and 20 have different senses of rotation.

Figure 7:
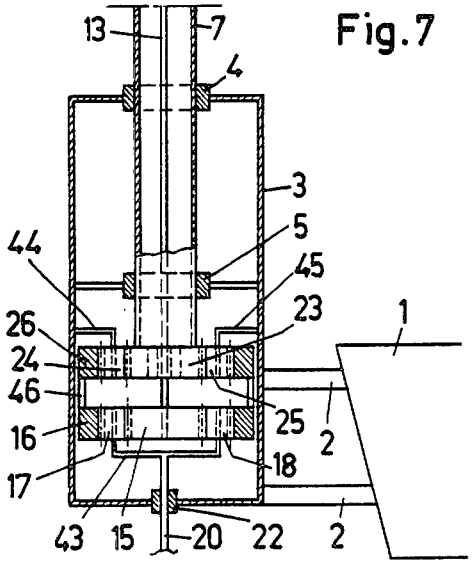

As in the embodiment of FIG. 6, in the embodiment of FIG. 7 the differential gears are formed with straight gear wheels which are co-planar in each differential gear. The wheels of these differential gears are interconnected in the manner of the bevel gears of the embodiment shown in FIG. 2.

Thus the first differential gear, shown in the bottom part of FIG. 7, comprises a central gear wheel 15 fixedly mounted on rod 13, which is directly controlled by the weather vane. Planet wheels 17 and 18 of this first differential gear are mounted on shafts 43 which are fixedly connected to the shaft 20 leading to the rudder. The crown wheel 16, which forms the first gear wheel of the first differential gear is directly connected to the crown wheel 26, which forms the first gear wheel of the second differential gear. Planet wheels 24 and 25 of the second differential gear are mounted on shafts 44 and 45, which are fixedly connected to the wall of gearbox 3, and the second gear wheel 23 of this second differential gear is fixedly connected to shaft 7 of the turntable.

The operation of the embodiment of FIG. 7 is not basically different from that of the embodiment illustrated in FIG. 2.

As compared with prior weather-vane steering-devices, the device according to the present invention offers important advantages in each of its embodiments.

Irrespective of the adjusted position of the turntable relative to the longitudinal axis of the boat, a deviation from the wind will cause a deviation of the steering element, rudder, auxiliary rudder, trimming surface or pendulum relative to the fixed axis of the vessel, and this without it being necessary for the transmission mechanism to be uncoupled and irrespective of the number of revolutions made by the turntable.

An important advantage consists in that the transmission mechanism only has rotating elements and no elements performing a translation. Rotary transmissions permit inexpensive and accurate manufacture and have a low friction. Rotary shafts can easily be sealed against the ingress of water. Use can be made of a weather vane having a spindle varying in slope between 0° en 90° relative to the horizontal plane. Without additional devices, use can be made of a weather vane having a double vertical spindle or of a weather vane having a double horizontal spindle or of a weather vane having a double sloping spindle. Without additional means, a propeller vane can be mounted on the turntable.

The invention is not, for that matter, limited in any way to the embodiments described above, and many modifications can be made in the embodiments described without departing from the scope of the present invention, among other things as regards form, composition, arrangement, and number of the parts used for the implementation of the invention.

Thus, for example, it is not necessary for the two differential gears in one device to be both formed with bevel gears or both with straight gears. It is also possible to construct one differential gear with bevel gears and another with straight gears.

The coupling devices shown in the drawings must not necessarily be used with the weather vanes shown in the same drawings. On the contrary, any proposed coupling device can be combined with any proposed weather-vane steering-device.

I claim:

1. A weather-vane steering-device comprising:

a gearbox to be fixedly secured to a boat, a turntable rotatable in the gearbox about a substantially vertical axis, a weather vane mounted for rotation relative to said turntable, a steering element mounted for rotation relative to the gearbox, a connection between the turntable and the gearbox with the possibility of adjustment, and a connection between the weather vane and the steering element wherein the connection between the weather vane and the steering element consists in a first differential gear, the connection between the turntable and the gearbox consists in a second differential gear, and a freely rotating member of the first differential gear is connected to a freely rotating member of the second differential gear.

2. A weather-vane steering-device as claimed in claim 1, wherein the two differential gears have the same coefficient of transmission.

3. A weather-vane steering device as claimed in claim 1, wherein the first differential gear comprises a first gear wheel directly coupled to the steering element, a second gear wheel directly coupled to the weather vane and at least one planet wheel loosely mounted on a free spindle and in engagement with the first and with the second gear wheel, the second differential gear comprises a first gear wheel fixedly connected to the gearbox, a second gear wheel fixedly connected to the turntable, and at least one planet wheel loosely mounted around a free spindle and in engagement with the first and the second gear wheel; and the free spindles mounting the planet wheels of the first and second differential gear are interconnected.

4. The device as claimed in claim 3, wherein the free spindles mounting the planet wheels of the first and of the second differential gear are one element.

5. A weather-vane steering-device as claimed in claim 1, wherein the first differential gear comprises a first freely rotating gear wheel, a second gear wheel directly coupled to the weather-vane, and at least one planet wheel loosely mounted around a spindle directly coupled to the steering element and in engagement with the first and with the second gear wheel; the second differential gear comprises a first freely rotating gear wheel, a second gear wheel fixed relative to the turntable, and at least one planet wheel loosely mounted around a spindle fixedly connected to the gearbox and in engagement with the first and with the second gear wheel; and the first gear wheels of the first and of the second differential gear are interconnected.

6. A weather-vane steering device as claimed in claim 5 wherein a planet wheel of the second differential gear is fixedly mounted on its spindle, which is mounted for rotation in the gearbox and provided with a crank.

7. A weather-vane steering-device as claimed in claim 1, wherein gear wheels of at least one differential gear are bevel gears.

8. A weather-vane steering-device as claimed in claim 1 wherein the gear wheels of at least one differential gear are straight co-planar gear wheels, in which one gear wheel is an internally geared crown wheel.

9. A weather-vane steering-device as claimed in claim 1, wherein a gear wheel of the second differential gear is provided with a drive element.

10. A weather-vane steering-device comprising: a gearbox to be fixedly secured to a boat, a turntable comprising a top portion and a lower portion, said lower portion being rotatable in the gearbox about a substantially vertical axis and said top portion pivoting about a substantially horizontal shaft relative to said lower portion, a means for fixedly securing said top portion relative to said lower portion, a weather-vane comprising a spindle journalled in said top portion of said turntable, a first shaft journalled vertically in said lower portion of said turntable, a second shaft connecting by means of two universal joints said spindle to said first shaft, a steering element mounted for rotation relative to said gearbox, a connection between said lower portion of said turntable and said gearbox with the possibility of adjustment and a connection between said first shaft and said steering element.

* * * * *